US010294933B2

(12) United States Patent
Locke et al.

(10) Patent No.: US 10,294,933 B2
(45) Date of Patent: May 21, 2019

(54) SYSTEMS AND METHODS FOR SUPPLYING REDUCED PRESSURE USING A DISC PUMP WITH ELECTROSTATIC ACTUATION

(71) Applicant: KCI Licensing, Inc., San Antonio, TX (US)

(72) Inventors: Christopher Brian Locke, Bournemouth (GB); Aidan Marcus Tout, Alderbury (GB)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 15/666,372

(22) Filed: Aug. 1, 2017

(65) Prior Publication Data

US 2017/0342971 A1 Nov. 30, 2017

Related U.S. Application Data

(62) Division of application No. 13/935,000, filed on Jul. 3, 2013, now Pat. No. 9,752,565.

(Continued)

(51) Int. Cl.

| | |
|---|---|
| ***F04F 7/02*** | (2006.01) |
| ***F04B 43/04*** | (2006.01) |
| ***F04B 45/047*** | (2006.01) |

(52) U.S. Cl.

CPC ..... *F04B 43/04* (2013.01); *F04B 43/046* (2013.01); *F04B 45/047* (2013.01); *F04F 7/02* (2013.01)

(58) Field of Classification Search

CPC ..... F04B 43/043; F04B 43/04; F04B 43/046; F04B 43/047; F04B 45/047; F05B 53/00; F04F 7/02

(Continued)

(56) References Cited

U.S. PATENT DOCUMENTS

| | | | |
|---|---|---|---|
| 1,355,846 | A | 10/1920 | Rannells |
| 2,547,758 | A | 4/1951 | Keeling |

(Continued)

FOREIGN PATENT DOCUMENTS

| | | | |
|---|---|---|---|
| AU | 550575 | B2 | 3/1986 |
| AU | 745271 | B2 | 3/2002 |

(Continued)

OTHER PUBLICATIONS

English Abstract of JP54093205A dated Jul. 1979.*

(Continued)

*Primary Examiner* — Nathan C Zollinger

(57) ABSTRACT

A disc pump includes a pump body having a cavity for containing a fluid. The disc pump also includes an actuator adapted to hold an electrostatic charge to cause an oscillatory motion at a drive frequency. The disc pump further includes a conductive plate positioned to face the actuator outside of the cavity and adapted to provide an electric field of reversible polarity, the conductive plate being electrically associated with the actuator to cause the actuator to oscillate at the drive frequency in response to reversing the polarity of the electric field. The disc pump further includes a valve disposed in at least one of a first aperture and a second aperture in the pump body. The oscillation of the actuator at the drive frequency causes fluid flow through the first aperture and the second aperture when in use.

12 Claims, 9 Drawing Sheets

Related U.S. Application Data

(60) Provisional application No. 61/668,093, filed on Jul. 5, 2012.

(58) Field of Classification Search
USPC ..... 417/413.1, 413.2, 413.3
See application file for complete search history.

(56) References Cited

U.S. PATENT DOCUMENTS 2,632,443 A 3/1953 Lesher
2,682,873 A 7/1954 Evans et al.
2,910,763 A 11/1959 Lauterbach
2,969,057 A 1/1961 Simmons
3,066,672 A 12/1962 Crosby, Jr. et al.
3,367,332 A 2/1968 Groves
3,520,300 A 7/1970 Flower, Jr.
3,568,675 A 3/1971 Harvey
3,648,692 A 3/1972 Wheeler
3,682,180 A 8/1972 McFarlane
3,826,254 A 7/1974 Mellor
4,080,970 A 3/1978 Miller
4,096,853 A 6/1978 Weigand
4,139,004 A 2/1979 Gonzalez, Jr.
4,165,748 A 8/1979 Johnson
4,184,510 A 1/1980 Murry et al.
4,233,969 A 11/1980 Lock et al.
4,245,630 A 1/1981 Lloyd et al.
4,256,109 A 3/1981 Nichols
4,261,363 A 4/1981 Russo
4,275,721 A 6/1981 Olson
4,284,079 A 8/1981 Adair
4,297,995 A 11/1981 Golub
4,333,468 A 6/1982 Geist
4,373,519 A 2/1983 Errede et al.
4,382,441 A 5/1983 Svedman
4,392,853 A 7/1983 Muto
4,392,858 A 7/1983 George et al.
4,419,097 A 12/1983 Rowland
4,465,485 A 8/1984 Kashmer et al.
4,475,909 A 10/1984 Eisenberg
4,480,638 A 11/1984 Schmid
4,525,166 A 6/1985 Leclerc
4,525,374 A 6/1985 Vaillancourt
4,540,412 A 9/1985 Van Overloop
4,543,100 A 9/1985 Brodsky
4,548,202 A 10/1985 Duncan
4,551,139 A 11/1985 Plaas et al.
4,569,348 A 2/1986 Hasslinger
4,605,399 A 8/1986 Weston et al.
4,608,041 A 8/1986 Nielsen
4,640,688 A 2/1987 Hauser
4,655,754 A 4/1987 Richmond et al.
4,664,662 A 5/1987 Webster
4,710,165 A 12/1987 McNeil et al.
4,733,659 A 3/1988 Edenbaum et al.
4,743,232 A 5/1988 Kruger
4,758,220 A 7/1988 Sundblom et al.
4,787,888 A 11/1988 Fox
4,826,494 A 5/1989 Richmond et al.
4,838,883 A 6/1989 Matsuura
4,840,187 A 6/1989 Brazier
4,863,449 A 9/1989 Therriault et al.
4,872,450 A 10/1989 Austad
4,878,901 A 11/1989 Sachse
4,897,081 A 1/1990 Poirier et al.
4,906,233 A 3/1990 Moriuchi et al.
4,906,240 A 3/1990 Reed et al.
4,919,654 A 4/1990 Kalt
4,941,882 A 7/1990 Ward et al.
4,953,565 A 9/1990 Tachibana et al.
4,969,880 A 11/1990 Zamierowski
4,985,019 A 1/1991 Michelson
5,037,397 A 8/1991 Kalt et al.
5,086,170 A 2/1992 Luheshi et al.
5,092,858 A 3/1992 Benson et al.
5,100,396 A 3/1992 Zamierowski
5,134,994 A 8/1992 Say
5,149,331 A 9/1992 Ferdman et al.
5,167,613 A 12/1992 Karami et al.
5,176,663 A 1/1993 Svedman et al.
5,215,522 A 6/1993 Page et al.
5,232,453 A 8/1993 Plass et al.
5,261,893 A 11/1993 Zamierowski
5,278,100 A 1/1994 Doan et al.
5,279,550 A 1/1994 Habib et al.
5,298,015 A 3/1994 Komatsuzaki et al.
5,342,376 A 8/1994 Ruff
5,344,415 A 9/1994 DeBusk et al.
5,358,494 A 10/1994 Svedman
5,437,622 A 8/1995 Carion
5,437,651 A 8/1995 Todd et al.
5,527,293 A 6/1996 Zamierowski
5,542,821 A * 8/1996 Dugan ..... F04B 7/0076 417/322
5,549,584 A 8/1996 Gross
5,556,375 A 9/1996 Ewall
5,607,388 A 3/1997 Ewall
5,636,643 A 6/1997 Argenta et al.
5,645,081 A 7/1997 Argenta et al.
5,764,258 A * 6/1998 Hetzer ..... B41J 2/14314 347/35
6,071,267 A 6/2000 Zamierowski
6,135,116 A 10/2000 Vogel et al.
6,241,747 B1 6/2001 Ruff
6,287,316 B1 9/2001 Agarwal et al.
6,345,623 B1 2/2002 Heaton et al.
6,488,643 B1 12/2002 Tumey et al.
6,493,568 B1 12/2002 Bell et al.
6,553,998 B2 4/2003 Heaton et al.
6,814,079 B2 11/2004 Heaton et al.
6,948,918 B2 * 9/2005 Hansen ..... A61M 5/14224 417/395
8,308,452 B2 * 11/2012 Amirouche ..... F04B 43/046 417/413.2
8,353,682 B2 * 1/2013 Patrascu ..... F04B 43/043 417/322
10,125,760 B2 * 11/2018 Tanaka ..... F04B 43/02
2002/0077661 A1 6/2002 Saadat
2002/0115951 A1 8/2002 Norstrem et al.
2002/0120185 A1 8/2002 Johnson
2002/0143286 A1 10/2002 Tumey
2005/0225201 A1 * 10/2005 Vogeley ..... F04B 43/046 310/317
2009/0087323 A1 * 4/2009 Blakey ..... F04B 43/046 417/413.2
2010/0310397 A1 * 12/2010 Janse Van Rensburg ..... F04B 43/04 417/488
2014/0273796 A1 * 9/2014 Giammattei ..... F04B 43/046 454/251

FOREIGN PATENT DOCUMENTS

AU 755496 B2 12/2002
CA 2005436 A1 6/1990
DE 26 40 413 A1 3/1978
DE 43 06 478 A1 9/1994
DE 29 504 378 U1 9/1995
EP 0100148 A1 2/1984
EP 0117632 A2 9/1984
EP 0161865 A2 11/1985
EP 0358302 A2 3/1990
EP 1018967 A1 7/2000
GB 692578 A 6/1953
GB 2 195 255 A 4/1988
GB 2 197 789 A 6/1988
GB 2 220 357 A 1/1990
GB 2 235 877 A 3/1991
GB 2 329 127 A 3/1999
GB 2 333 965 A 8/1999
JP 54093205 A * 7/1979
JP 4129536 B2 8/2008
SG 71559 4/2002

(56) References Cited

FOREIGN PATENT DOCUMENTS

| | | | |
|---|---|---|---|
| WO | 80/02182 | A1 | 10/1980 |
| WO | 87/04626 | A1 | 8/1987 |
| WO | 90/010424 | A1 | 9/1990 |
| WO | 93/009727 | A1 | 5/1993 |
| WO | 94/020041 | A1 | 9/1994 |
| WO | 96/05873 | A1 | 2/1996 |
| WO | 97/18007 | A1 | 5/1997 |
| WO | 99/13793 | A1 | 3/1999 |

OTHER PUBLICATIONS

Louis C. Argenta, MD and Michael J. Morykwas, PHD; Vacuum-Assisted Closure: A New Method for Wound Control and Treatment: Clinical Experience; Annals of Plastic Surgery.
Susan Mendez-Eatmen, RN; "When wounds Won't Heal" RN Jan. 1998, vol. 61 (1); Medical Economics Company, Inc., Montvale, NJ, USA; pp. 20-24.
James H. Blackburn II, MD et al.: Negative-Pressure Dressings as a Bolster for Skin Grafts; Annals of Plastic Surgery, vol. 40, No. 5, May 1998, pp. 453-457; Lippincott Williams & Wilkins, Inc., Philidelphia, PA, USA.
John Masters; "Reliable, Inexpensive and Simple Suction Dressings"; Letter to the Editor, British Journal of Plastic Surgery, 198, vol. 51 (3), p. 267; Elsevier Science/The British Association of Plastic Surgeons, UK.
S.E. Greer, et al. "The Use of Subatmospheric Pressure Dressing Therapy to Close Lymphocutaneous Fistulas of the Groin" British Journal of Plastic Surgery (2000), 53, pp. 484-487.
George V. Letsou, MD., et al; "Stimulation of Adenylate Cyclase Activity in Cultured Endothelial Cells Subjected to Cyclic Stretch"; Journal of Cardiovascular Surgery, 31, 1990, pp. 634-639.
Orringer, Jay, et al; "Management of Wounds in Patients with Complex Enterocutaneous Fistulas"; Surgery, Gynecology & Obstetrics, Jul. 1987, vol. 165, pp. 79-80.
International Search Report for PCT International Application PCT/GB95/01983; dated Nov. 23, 1995.
PCT International Search Report for PCT International Application PCT/GB98/02713; dated Jan. 8, 1999.
PCT Written Opinion; PCT International Application PCT/GB98/02713; dated Jun. 8, 1999.
PCT International Examination and Search Report, PCT International Application PCT/GB96/02802; dated Jan. 15, 1998 & Apr. 29, 1997.
PCT Written Opinion, PCT International Application PCT/GB96/02802; dated Sep. 3, 1997.
Dattilo, Philip P., Jr., et al; "Medical Textiles: Application of an Absorbable Barbed Bi-directional Surgical Suture"; Journal of Textile and Apparel, Technology and Management, vol. 2, Issue 2, Spring 2002, pp. 1-5.
Kostyuchenok, B.M., et al; "Vacuum Treatment in the Surgical Management of Purulent Wounds"; Vestnik Khirurgi, Sep. 1986, pp. 18-21 and 6 page English translation thereof.
Davydov, Yu. A., et al; "Vacuum Therapy in the Treatment of Purulent Lactation Mastitis"; Vestnik Khirurgi, May 14, 1986, pp. 66-70, and 9 page English translation thereof.
Yusupov. Yu.N., et al; "Active Wound Drainage", Vestnki Khirurgi, vol. 138, Issue 4, 1987, and 7 page English translation thereof.
Davydov, Yu.A., et al; "Bacteriological and Cytological Assessment of Vacuum Therapy for Purulent Wounds"; Vestnik Khirugi, Oct. 1988, pp. 48-52, and 8 page English translation thereof.
Davydov, Yu.A., et al; "Concepts for the Clinical-Biological Management of the Wound Process in the Treatment of Purulent Wounds by Means of Vacuum Therapy"; Vestnik Khirurgi, Jul. 7, 1980, pp. 132-136, and 8 page English translation thereof.
Chariker, Mark E., M.D., et al; "Effective Management of incisional and cutaneous fistulae with closed suction wound drainage"; Contemporary Surgery, vol. 34, Jun. 1989, pp. 59-63.
Egnell Minor, Instruction Book, First Edition, 300 7502, Feb. 1975, p. 24.
Egnell Minor: Addition to the Users Manual Concerning Overflow Protection—Concerns all Egnell Pumps, Feb. 3, 1983, p. 2.
Svedman, P.: "Irrigation Treatment of Leg Ulcers", The Lancet, Sep. 3, 1983, pp. 532-534.
Chinn, Steven D. et al.: "Closed Wound Suction Drainage", The Journal of Foot Surgery, vol. 24, No. 1, 1985, pp. 76-81.
Arnljots, Björn et al.: "Irrigation Treatment in Split-Thickness Skin Grafting of Intractable Leg Ulcers", Scand J. Plast Reconstr. Surg., No. 19, 1985, pp. 211-213.
Svedman, P.: "A Dressing Allowing Continuous Treatment of a Biosurface", IRCS Medical Science: Biomedical Technology, Clinical Medicine, Surgery and Transplantation, vol. 7, 1979, p. 221.
Svedman, P. et al: "A Dressing System Providing Fluid Supply and Suction Drainage Used for Continuous of Intermittent Irrigation", Annals of Plastic Surgery, vol. 17, No. 2, Aug. 1986, pp. 125-133.
N.A. Bagautdinov, "Variant of External Vacuum Aspiration in the Treatment of Purulent Diseases of Soft Tissues," Current Problems in Modern Clinical Surgery: Interdepartmental Collection, edited by V. Ye Volkov et al. (Chuvashia State University, Cheboksary, U.S.S.R. 1986); pp. 94-96 (copy and certified translation).
K.F. Jeter, T.E. Tintle, and M. Chariker, "Managing Draining Wounds and Fistulae: New and Established Methods," Chronic Wound Care, edited by D. Krasner (Health Management Publications, Inc., King of Prussia, PA 1990), pp. 240-246.
G. Živadinovi?, V. ?uki?, Ž. Maksimovi?, ?. Radak, and P. Peška, "Vacuum Therapy in the Treatment of Peripheral Blood Vessels," Timok Medical Journal 11 (1986), pp. 161-164 (copy and certified translation).
F.E. Johnson, "An Improved Technique for Skin Graft Placement Using a Suction Drain," Surgery, Gynecology, and Obstetrics 159 (1984), pp. 584-585.
A.A. Safronov, Dissertation Abstract, Vacuum Therapy of Trophic Ulcers of the Lower Leg with Simultaneous Autoplasty of the Skin (Central Scientific Research Institute of Traumatology and Orthopedics, Moscow, U.S.S.R. 1967) (copy and certified translation).
M. Schein, R. Saadia, J.R. Jamieson, and G.A.G. Decker, "The 'Sandwich Technique' in the Management of the Open Abdomen," British Journal of Surgery 73 (1986), pp. 369-370.
D.E. Tribble, An Improved Sump Drain-Irrigation Device of Simple Construction, Archives of Surgery 105 (1972) pp. 511-513.
M.J. Morykwas, L.C. Argenta, E.I. Shelton-Brown, and W. McGuirt, "Vacuum-Assisted Closure: A New Method for Wound Control and Treatment: Animal Studies and Basic Foundation," Annals of Plastic Surgery 38 (1997), pp. 553-562 (Morykwas I).
C.E. Tennants, "The Use of Hypermia in the Postoperative Treatment of Lesions of the Extremities and Thorax," Journal of the American Medical Association 64 (1915), pp. 1548-1549.
Selections from W. Meyer and V. Schmieden, Bier's Hyperemic Treatment in Surgery, Medicine, and the Specialties: A Manual of Its Practical Application, (W.B. Saunders Co., Philadelphia, PA 1909), pp. 17-25, 44-64, 90-96, 167-170, and 210-211.
V.A. Solovev et al., Guidelines, The Method of Treatment of Immature External Fistulas in the Upper Gastrointestinal Tract, editor-in-chief Prov. V.I. Parahonyak (S.M. Kirov Gorky State Medical Institute, Gorky, U.S.S.R. 1987) ("Solovev Guidelines").
V.A. Kuznetsov & N.a. Bagautdinov, "Vacuum and Vacuum-Sorption Treatment of Open Septic Wounds," in II All-Union Conference on Wounds and Wound Infections: Presentation Abstracts, edited by B.M. Kostyuchenok et al. (Moscow, U.S.S.R. Oct. 28-29, 1986) pp. 91-92 ("Bagautdinov II").
V.A. Solovev, Dissertation Abstract, Treatment and Prevention of Suture Failures after Gastric Resection (S.M. Kirov Gorky State Medical Institute, Gorky, U.S.S.R. 1988) ("Solovev Abstract").
V.A.C.® Therapy Clinical Guidelines: A Reference Source for Clinicians; Jul. 2007.

* cited by examiner

SYSTEMS AND METHODS FOR SUPPLYING REDUCED PRESSURE USING A DISC PUMP WITH ELECTROSTATIC ACTUATION

This application is a divisional of U.S. patent application Ser. No. 13/935,000, filed Jul. 3, 2013, which claims the benefit, under 35 USC § 119(e), of the filing of U.S. Provisional Patent Application No. 61/668,093, entitled "Systems and Methods for Supplying Reduced Pressure Using a Disc Pump with Electrostatic Actuation," filed Jul. 5, 2012, by Locke et al., which is incorporated herein by reference for all purposes.

BACKGROUND OF THE INVENTION

1. Field of the Invention

The illustrative embodiments of the invention relate generally to a disc pump system for pumping fluid and, more specifically, but without limitation to, a disc pump having an electrostatic drive mechanism.

2. Description of Related Art

The generation of high amplitude pressure oscillations in closed cavities has received significant attention in the fields of disc pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, and bulb have been used to achieve high amplitude pressure oscillations, thereby significantly increasing the pumping effect. In such high amplitude waves, the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775, discloses a disc pump having a substantially disc-shaped cavity with a high aspect ratio, i.e., the ratio of the radius of the cavity to the height of the cavity.

Such a disc pump has a substantially cylindrical cavity comprising a side wall closed at each end by end walls. The disc pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the disc pump is mode-matched, work done by the actuator on the fluid in the cavity adds constructively across the driven end wall surface, thereby enhancing the amplitude of the pressure oscillation in the cavity and delivering high disc pump efficiency. The efficiency of a mode-matched disc pump is dependent upon the interface between the driven end wall and the side wall. It is desirable to maintain the efficiency of such a disc pump by structuring the interface to not decrease or dampen the motion of the driven end wall, thereby mitigating any reduction in the amplitude of the fluid pressure oscillations within the cavity.

The actuator of the disc pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in International Patent Application No. PCT/GB2006/001487, which is incorporated by reference herein. Such oscillations are referred to hereinafter as "radial oscillations" of the fluid pressure within the cavity. A portion of the driven end wall between the actuator and the side wall provides an interface with the side wall of the disc pump that decreases dampening of the displacement oscillations to mitigate any reduction of the pressure oscillations within the cavity. The portion of the driven end wall that provides such an interface is referred to hereinafter as an "isolator" as described more specifically in U.S. patent application Ser. No. 12/477,594, which is incorporated by reference herein. The illustrative embodiments of the isolator are operatively associated with the peripheral portion of the driven end wall to reduce dampening of the displacement oscillations.

Such disc pumps also have one or more valves for controlling the flow of fluid through the disc pump and, more specifically, valves being capable of operating at high frequencies. Conventional valves typically operate at lower frequencies below 500 Hz for a variety of applications. For example, many conventional compressors typically operate at 50 or 60 Hz. Linear resonance compressors known in the art operate between 150 and 350 Hz. Yet many portable electronic devices, including medical devices, require disc pumps for delivering a positive pressure or providing a vacuum. The disc pumps are relatively small in size and it is advantageous for such disc pumps to be inaudible in operation to provide discrete operation. To achieve these objectives, such disc pumps must operate at very high frequencies requiring valves capable of operating at about 20 kHz and higher. To operate at these high frequencies, the valve must be responsive to a high frequency oscillating pressure that can be rectified to create a net flow of fluid through the disc pump.

Such a valve is described more specifically in International Patent Application No. PCT/GB2009/050614, which is incorporated by reference herein. Valves may be disposed in either the first or second aperture, or both apertures, for controlling the flow of fluid through the disc pump. Each valve comprises a first plate having apertures extending generally perpendicular therethrough and a second plate also having apertures extending generally perpendicular therethrough, wherein the apertures of the second plate are substantially offset from the apertures of the first plate. The valve further comprises a sidewall disposed between the first and second plate, wherein the sidewall is closed around the perimeter of the first and second plates to form a cavity between the first and second plates in fluid communication with the apertures of the first and second plates. The valve further comprises a flap disposed and moveable between the first and second plates, wherein the flap has apertures substantially offset from the apertures of the first plate and substantially aligned with the apertures of the second plate. The flap is motivated between the first and second plates in response to a change in direction of the differential pressure of the fluid across the valve.

SUMMARY

According to an illustrative embodiment, a disc pump system includes a pump body having a substantially cylindrical shape defining a cavity for containing a fluid. The cavity is formed by a side wall closed at both ends by substantially circular end walls. At least one of the end walls is a driven end wall having a central portion and a peripheral portion extending radially outwardly from the central portion of the driven end wall. An electrostatically-driven actuator is operatively associated with the central portion of the driven end wall to cause an oscillatory motion of the driven end wall and generate displacement oscillations of the driven end wall in a direction substantially perpendicular thereto. A conductive plate is operatively associated with the cavity and substantially parallel to the electrostatically-driven actuator. A first aperture is disposed in either one of the end walls and extending through the pump body. In addition, one or more second apertures are disposed in the pump body and extend through the pump body. The disc pump system also includes a valve disposed in at least one of the first aperture and second apertures.

According to another illustrative embodiment, a disc pump system has a pump body and has a substantially cylindrical shape defining a cavity for containing a fluid. The cavity is formed by a side wall closed at both ends by substantially circular end walls. At least one of the end walls is a driven end wall having a central portion and a peripheral portion extending radially outwardly from the central portion. The system includes an actuator, which has a conductive layer and is operatively associated with the central portion of the driven end wall to cause an oscillatory motion of the driven end wall. The oscillatory motion of the driven end wall generates displacement oscillations of the driven end wall in a direction substantially perpendicular thereto. A conductive plate is operatively associated with the cavity and substantially parallel to the electrostatically-driven actuator, and a first aperture is disposed in either one of the end walls. The first aperture extends through the pump body. One or more second apertures are disposed in the pump body and extend through the pump body. A valve is disposed in at least one of said first aperture and second apertures.

In another illustrative embodiment, a method for operating a disc pump includes applying a drive signal to a conductive plate of a disc pump to cause the conductive plate to switch between a positive and a negative charge. The method also includes driving an actuator of the disc pump and generating displacement oscillations of the actuator in a direction substantially perpendicular to its surface. In addition, the method includes generating pressure oscillations of fluid within the cavity to cause fluid flow through a valve of the disc pump, the pressure oscillations corresponding to the displacement oscillations.

Other features and advantages of the illustrative embodiments will become apparent with reference to the drawings and detailed description that follow.

DETAILED DESCRIPTION OF ILLUSTRATIVE EMBODIMENTS

The description of the art included above indicates that, in a typical disc pump, the spatial profile of the motion of the driven end wall is matched to the spatial profile of the fluid pressure oscillations within the cavity. This state is described as mode-matching. Yet mode-matching may constrain many characteristics of a disc pump because, in the case of a piezo-electric disc pump, mode matching establishes a relationship between the geometry of a pump cavity, the resonant frequency of a piezo-electric actuator (including the material and shape of the actuator) and the operating temperatures of the pump. To enhance the flexibility of a disc pump, it may be desirable to provide a disc pump that does not require a piezo-electric actuator.

In the following detailed description of several illustrative embodiments, reference is made to the accompanying drawings that form a part hereof. By way of illustration, the accompanying drawings show specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1A:
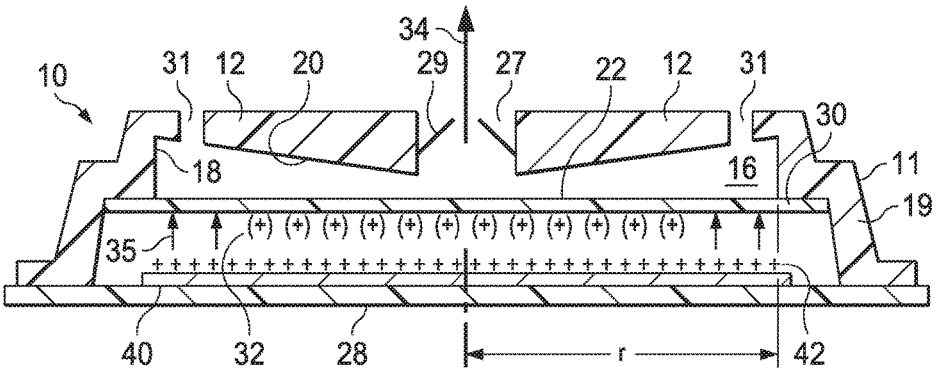
FIG. 1A is a cross-section view of a first disc pump having an electrostatically-driven actuator having a constant surface charge and a positively-charged conductive plate.
Figure 1B:
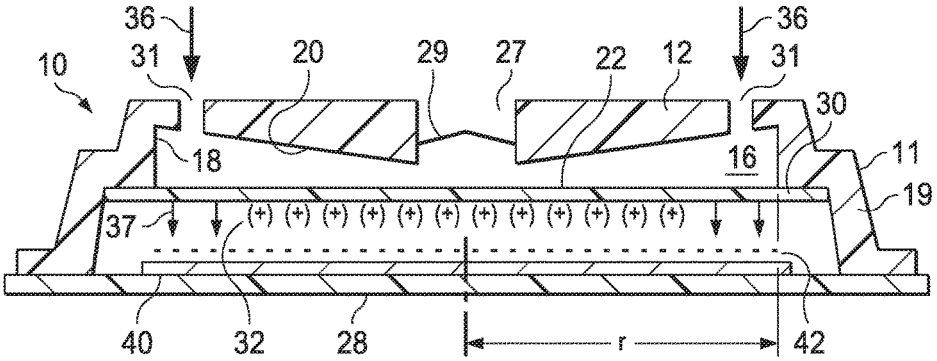
FIG. 1B is a cross-section view of the first disc pump having an electrostatically-driven actuator having a constant surface charge and a negatively-charged conductive plate.
Figure 2:
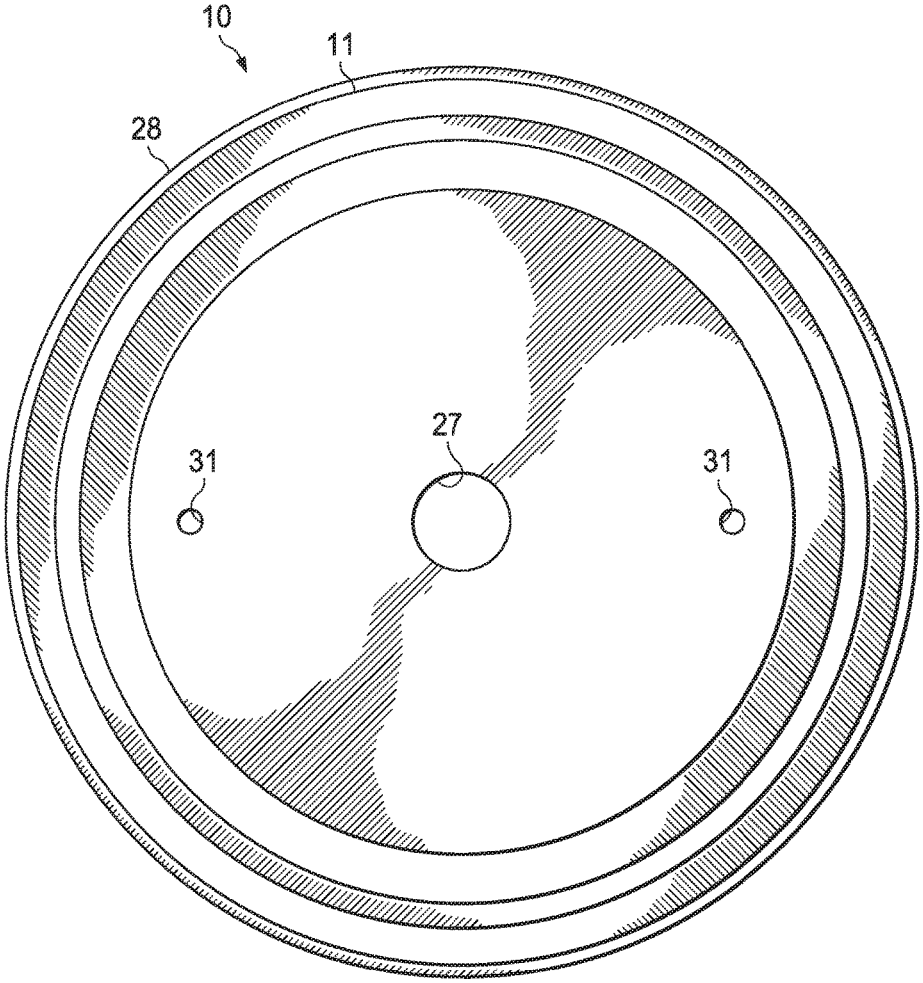
FIG. 2 is a top view of the first disc pump of FIGS. 1A and 1B.

FIGS. 1A-1B show an illustrative embodiment of a disc pump 10 having an electrostatic drive mechanism rather than a piezo-electric drive mechanism. The disc pump 10 comprises a pump body 11 having a substantially elliptical shape including a cylindrical wall 18 and a cylindrical leg structure 19 extending from the cylindrical wall 18. The cylindrical leg structure is mounted to a substrate 28, which may be a printed circuit board or another suitable rigid or semi-rigid material. The pump body 11 is closed at one end by the substrate 28 and at the other end by an end plate 12 having an inner surface or end wall 20. The end plate 12 may be formed integrally to the pump body 11 or as a separate component. The disc pump 10 further comprises an actuator 30 disposed between the end wall 20 and the substrate 28, and affixed to the cylindrical wall 18 of the disc pump body 11 by chemical bonding, welding, a close fit, or another suitable joining process. The actuator 30 forms an end wall 22 that is the inner surface of the actuator 30 that faces the end wall 20. The actuator 30 is an electrostatically-driven actuator formed from a flexible material affixed to the pump body 11 about the periphery of the actuator 30. The disc pump 10 further comprises a conductive plate 40 that is mounted to or incorporated within the substrate 28, and generally parallel to the actuator 30. The actuator 30 is offset from the conductive plate 40, which is coupled to a drive circuit and operatively associated with the pump body 11 to apply an electric field across the actuator 30. In one embodiment, the disc pump 10 also includes a second conductive plate (not shown) that is embedded within the end wall 22 and offset from the side of the actuator that is opposite the conductive plate 40. The second conductive plate may also be coupled to the drive circuit. The internal surface of the cylindrical wall 18 and the end walls 20, 22 form a cavity 16 within the disc pump 10. The cavity 16 is fluidly coupled to a load to supply positive or negative pressure to the load. Although the disc pump 10, including the cavity 16 and the end walls 20, 22 are substantially elliptical in shape, the specific embodiment disclosed herein is generally circular, as shown in FIG. 2.

The cylindrical wall 18 and the end wall 20 may be a single component comprising the disc pump body 11 or separate components. The end wall 20 defining the cavity 16 is shown as being generally frusto-conical, yet in another embodiment, the end wall 20 may include a generally planar surface that is parallel to the actuator 30. A disc pump comprising frusto-conical surfaces is described in more detail in the WO2006/111775 publication, which is incorporated by reference herein. The end wall 20 and the cylindrical wall 18 of the pump body 11 may be formed from suitable rigid materials including, without limitation, metal, ceramic, glass, or plastic including, without limitation, inject-molded plastic.

The actuator 30 is operatively associated with the end wall 22 and may be constructed of a thin Mylar film, or a similar material, to which a conductive coating has been applied. In another embodiment, the actuator 30 comprises a dielectric membrane, such as polyethylene or a silicone rubber. To enhance the actuator's ability to be driven by an electrostatic force, the actuator 30 may be placed in series with a power supply, such as a battery, that applies a constant charge to the actuator 30. To conduct and hold the charge, the actuator 30 may include a conductive coating or inner layer. In an embodiment, a resistor, capacitor, or other circuit element may be connected in series between the actuator 30 and the battery to maintain a constant charge on the surface of the actuator 30. To facilitate the electrical coupling of the actuator 30 and the conductive plate 40 to other electronic elements, circuit elements, including circuit paths and conductive traces, may be incorporated within the pump body 11 and the substrate 28 of the disc pump 10.

The disc pump 10 further comprises at least one aperture 27 extending from the cavity 16 to the outside of the disc pump 10, wherein the at least one aperture 27 contains a valve to control the flow of fluid through the aperture 27. Although the aperture 27 may be located at any position in the cavity 16 where the actuator 30 generates a pressure differential, one embodiment of the disc pump 10 comprises the aperture 27, located at approximately the center of and extending through the end wall 20. The aperture 27 contains at least one valve 29 that regulates the flow of fluid in one direction, as indicated by the arrow 34, so that the valve 29 functions as an outlet valve for the disc pump 10.

The disc pump 10 further comprises at least one additional aperture 31 extending through the actuator 30 or through the end wall 20. The additional aperture(s) 31 may be located at any position in the pump body 11. For example, the disc pump 10 comprises additional apertures 31 located about the periphery of the cavity 16 in the end wall 20.

The dimensions of the cavity 16 described herein should preferably satisfy certain inequalities with respect to the relationship between the height (h) of the cavity 16 at the side wall 18 and its radius (r) which is the distance from the longitudinal axis of the cavity 16 to the interior sidewall. These equations are as follows:

$r/h>1.2$; and $h^2/r>4\times10^{-10}$ meters.

In one embodiment of the invention, the ratio of the cavity radius to the cavity height (r/h) is between about 10 and about 50 when the fluid within the cavity 16 is a gas. In this example, the volume of the cavity 16 may be less than about 10 ml. Additionally, the ratio of $h^2/r$ is preferably within a range between about $10^{-6}$ and about $10^{-7}$ meters where the working fluid is a gas as opposed to a liquid.

Additionally, the cavity 16 disclosed herein should preferably satisfy the following inequality relating the cavity radius (r) and operating frequency (f), which is the frequency at which the actuator 30 oscillates to generate axial displacement of the end wall 22. The inequality is as follows:

$$\frac{k_0(c_s)}{2\pi f} \le r \le \frac{k_0(c_f)}{2\pi f} \quad \text{[Equation 1]}$$

wherein the speed of sound (c) in the working fluid within the cavity 16 may range between a slow speed ($c_s$) of about 115 m/s and a fast speed ($c_f$) equal to about 1,970 m/s as expressed in the equation above, and $k_0$ is a constant ($k_0$=3.83).

The variance in the speed of sound in the working fluid within the cavity 16 may relate to a number of factors, including the type of fluid within the cavity 16 and the temperature of the fluid. For example, if the fluid in the cavity 16 is an ideal gas, the speed of sound of the fluid may be understood as a function of the square root of the absolute temperature of the fluid. Thus, the speed of sound in the cavity 16 will vary as a result of changes in the temperature of the fluid in the cavity 16, and the size of the cavity 16 may be selected (in part) based on the anticipated temperature of the fluid.

The radius of the cavity 16 and the speed of sound in the working fluid in the cavity 16 are factors in determining the resonant frequency of the cavity 16. The resonant frequency of the cavity 16, or resonant cavity frequency ($f_c$), is the frequency at which the fluid (e.g., air) oscillates into and out of the cavity 16 when the pressure in the cavity 16 is increased relative to the ambient environment. In a preferred embodiment of the disc pump 10, the frequency (f) at which the actuator 30 oscillates is approximately equal to the resonant cavity frequency ($f_c$). In the embodiment, the working fluid is assumed to be air at 60° C., and the resonant cavity frequency ($f_c$) at an ambient temperature of 20° C. is 21 kHz. Although it is preferable that the cavity 16 disclosed herein should satisfy individually the inequalities identified above, the relative dimensions of the cavity 16 should not be limited to cavities having the same height and radius. For example, the cavity 16 may have a slightly different shape requiring different radii or heights creating different frequency responses so that the cavity 16 resonates in a desired fashion to generate the optimal output from the disc pump 10.

The disc pump 10 may function as a source of positive pressure adjacent the outlet valve 29 to pressurize a load or as a source of negative or reduced pressure adjacent the inlet aperture 31 to depressurize the load, as indicated by the arrows 36. The load may be, for example, a tissue treatment system that utilizes negative pressure for treatment. Here, the term reduced pressure generally refers to a pressure less than the ambient pressure where the disc pump 10 is located. Although the terms vacuum and negative pressure may be used to describe the reduced pressure, the actual pressure reduction may be significantly less than the pressure reduction normally associated with a complete vacuum. Here, the pressure is negative in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

In another embodiment, a disc pump 110 comprises an actuator 130 having a variable surface charge, as shown in FIGS. 3A-3D. The disc pump 110 is analogous in many respects to the first disc pump of FIGS. 1A, 1B, and 2 and many of the reference numerals of FIGS. 3A-3D refer to features that are analogous to the features of FIGS. 1A-1B having the same reference numerals indexed by 100. The actuator 130 of the disc pump 110 may be coupled to a drive circuit and have an active variable surface charge 132 that is supplied by the drive circuit, as opposed to a constant surface charge. In another embodiment, the actuator 130 has a passive, variable charge 132 that is induced by a surface charge 142 of a conductive plate 140. In one embodiment, the disc pump 110 includes an optional second conductive plate 141 that is also coupled to the drive circuit to generate an electric field that augments the electric field generated by the conductive plate 140.

Referring again to FIGS. 1A-1B, the disc pump 10 includes the actuator 30 and the conductive plate 40, which are coupled to the drive circuit to function as an electrostatic drive mechanism. The drive circuit applies a drive signal to the conductive plate 40 that creates a surface charge 42 that varies between a positive or negative charge on the surface of the conductive plate 40. The drive circuit or a separate power source is coupled to the actuator 30 to provide a constant surface charge 32 on the surface of the actuator 30. When the polarity of the charge 32 on the actuator 30 and the charge 42 on the conductive plate 40 are of similar polarities, a repulsive electromagnetic force drives the actuator 30 away from the conductive plate 40. In FIG. 1A, the repulsive electromagnetic force is represented by the arrows 35. When the surface charge 32 of the actuator 30 and the surface charge 42 of the conductive plate 40 are opposing charges, an attractive electromagnetic force urges the actuator 30 toward the conductive plate 40. The attractive electromagnetic force is represented by the arrows 37 in FIG. 1B. By alternating or reversing the charge 42 on the conductive plate 40 while applying a constant surface charge 32 to the actuator 30, the electrostatic drive mechanism causes oscillatory motion of the actuator 30. The oscillatory motion of the actuator 30, i.e., axial displacement, is generally perpendicular to the conductive plate 40 and functions to generate pressure oscillations within the cavity 16. In turn, the pressure oscillations may be used to generate a pressure differential across the disc pump 10 to provide reduced pressure to the load.

Figure 4A:
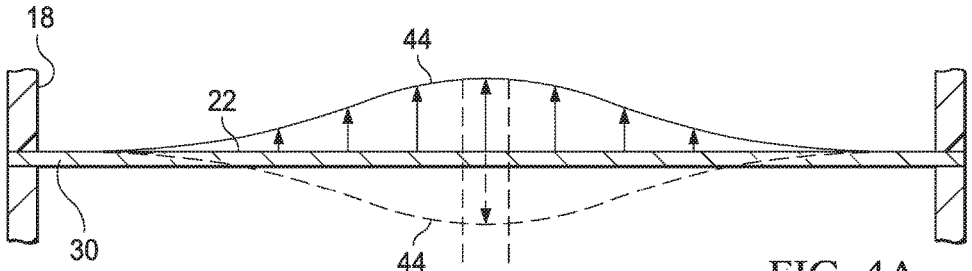
FIG. 4A shows a graph of the axial displacement oscillations for the actuator of the first disc pump of FIGS. 1A-1B.

FIG. 4A shows one possible displacement profile illustrating the axial oscillation of the actuator 30, which includes the driven end wall 22 of the cavity 16. The solid curved line and arrows represent the displacement of the driven end wall 22 at one point in time, and the dashed curved line represents the displacement of the driven end wall 22 one half-cycle later. The displacement as shown in this figure and the other figures is exaggerated. Because the actuator 30 is fixed about the periphery of the cavity 16, the maximum displacement occurs at a center portion of the actuator 30. The amplitudes of the displacement oscillations at other points on the end wall 22 are greater than zero as represented by the vertical arrows. A central displacement peak 44 exists near the center of the actuator 30 and no displacement exists at the perimeter of the actuator 30. The central displacement peak 44 is represented by the dashed curve after one half-cycle.

Figure 3A:
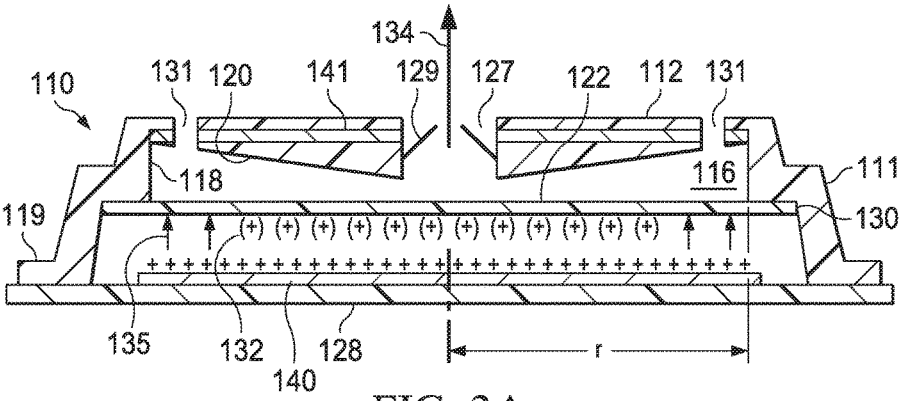
FIG. 3A is a cross-section view of a second disc pump having a positively-charged, electrostatically-driven actuator and a positively-charged conductive plate.
Figure 4B:
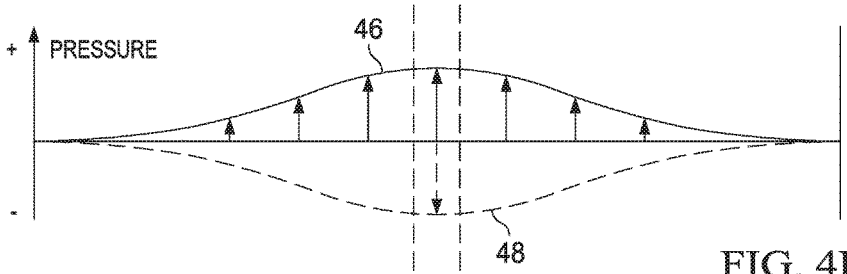
FIG. 4B shows a graph of the pressure oscillations of fluid within the cavity of the first disc pump in response to the displacement oscillations shown in FIG. 4A.

FIG. 4B shows a possible pressure oscillation profile within the cavity 16 that results from the axial displacement oscillations shown in FIG. 3A. The solid curved line and arrows represent the pressure at one point in time. In this mode, the amplitude of the pressure oscillations is substantially zero at the perimeter of the cavity 16 and maximized at the central positive pressure peak 46. At the same time, the amplitude of the pressure oscillations represented by the dashed line has a negative central pressure peak 48 near the center of the cavity 16. The pressure oscillations described above result from the radial movement of the fluid in the cavity 16 and so will be referred to as the "radial pressure oscillations" of the fluid within the cavity 16 as distinguished from the axial displacement oscillations of the actuator 30.

With further reference to FIGS. 4A and 4B, it can be seen that the radial dependence of the amplitude of the axial displacement oscillations of the actuator 30 (the "mode-shape" of the actuator 30) should approximate the radial dependence of the amplitude of the desired pressure oscillations in the cavity 16 (the "mode-shape" of the pressure oscillation). By allowing the actuator 30 to oscillate freely at the center of the cavity 16, the mode-shape of the displacement oscillations substantially matches the mode-shape of the pressure oscillations in the cavity 16 thus achieving mode-shape matching or, more simply, mode-matching. Although the mode-matching may not always be perfect in this respect, the axial displacement oscillations of the actuator 30 and the corresponding pressure oscillations in the cavity 16 have substantially the same relative phase across the full surface of the actuator 30.

Figure 3C:
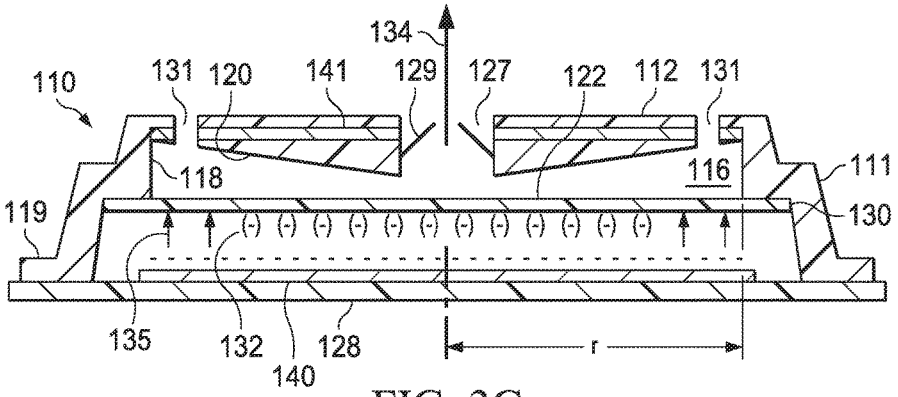
FIG. 3C is a cross-section view of the second disc pump having a negatively-charged, electrostatically-driven actuator and a negatively-charged conductive plate.
Figure 4C:
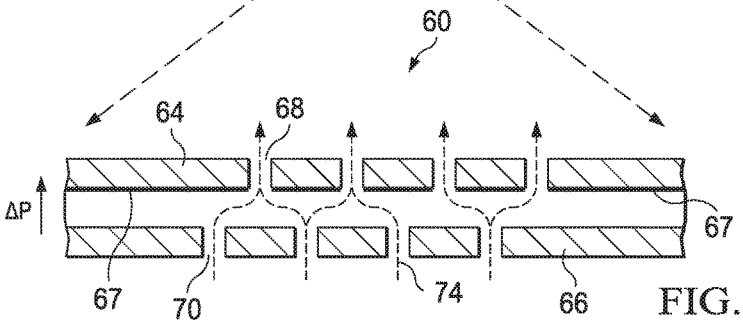
FIG. 4C shows the location of the center portion of a valve of the disc pump relative to the peak pressure oscillations within the cavity of the disc pump.

As indicated in FIG. 4C, the pressure oscillations generate fluid flow at the center of the cavity 16, where the valve 29 is located near the center of the pump body 11. In FIG. 3C, the valve 29 is represented by a flap valve 60. The fluid flow resulting from the pressure oscillations is maximized at the center of the cavity 16 and at the center portion of the valve 60, to motivate fluid through the valve 60. The valve 60 allows fluid to flow in only one direction, as indicated by the arrows 74, and may be a check valve or any other valve that allows fluid to flow in only one direction. Some valve types may regulate fluid flow by switching between an open and closed position. For such valves to operate at the high frequencies generated by the actuator 30, the valve 60 has an extremely fast response time such that the valve 60 opens and closes on a timescale significantly shorter than the timescale of the pressure variation. One embodiment of the valve 60 achieves this by employing an extremely light flap valve, which has low inertia and consequently is able to move rapidly in response to changes in relative pressure across the valve structure.

Referring to FIGS. 4C and 5A-5C, the valve 60 is a flap valve for the disc pump 10 according to an illustrative embodiment. The valve 60 comprises a substantially cylindrical wall 62 that is ring-shaped and closed at one end by a retention plate 64 and at the other end by a sealing plate 66. The wall 62 is formed by an interior surface of a ring-shaped spacer 71 or shim that spaces the sealing plate 66 from the retention plate 64. The inside surface of the wall 62, the retention plate 64, and the sealing plate 66 form a cavity 65 within the valve 60. The valve 60 further comprises a substantially circular flap 67 disposed between the retention plate 64 and the sealing plate 66, but adjacent the sealing plate 66. In this sense, the flap 67 is considered to be "biased" against the sealing plate 66. The peripheral portion of the flap 67 is sandwiched between the sealing plate 66 and the spacer 71 so that the motion of the flap 67 is restrained in the plane substantially perpendicular the surface of the flap 67. The motion of the flap 67 in such plane may also be restrained by the peripheral portion of the flap 67 being attached directly to either the sealing plate 66 or the wall 62, or by the flap 67 being a close fit within the ring-shaped wall 62, in an alternative embodiment. The remainder of the flap 67 is sufficiently flexible and movable in a direction substantially perpendicular to the surface of the flap 67, so that a force applied to either surface of the flap 67 will motivate the flap 67 between the sealing plate 66 and the retention plate 64.

The retention plate 64 and the sealing plate 66 both have holes 68 and 70, respectively, which extend through each plate. The flap 67 also has holes 72 that are generally aligned with the holes 68 of the retention plate 64 to provide a passage through which fluid may flow as indicated by the dashed arrows 74 in FIG. 5A. The holes 72 in the flap 67 may also be partially aligned, i.e., having only a partial overlap, with the holes 68 in the retention plate 64. Although the holes 68, 70, 72 are shown to be of substantially uniform size and shape, they may be of different diameters or even different shapes without limiting the scope of the invention. In one embodiment of the invention, the holes 68 and 70 form an alternating pattern across the surface of the plates in a top view. In other embodiments, the holes 68, 70, 72 may be arranged in different patterns without affecting the operation of the valve 60 with respect to the functioning of the individual pairings of holes 68, 70, 72 as illustrated by individual sets of the dashed arrows 74. The pattern of holes 68, 70, 72 may be designed to increase or decrease the number of holes to control the total flow of fluid through the valve 60 as necessary. For example, the number of holes 68, 70, 72 may be increased to reduce the flow resistance of the valve 60 to increase the total flow rate of the valve 60.

Figure 5A:
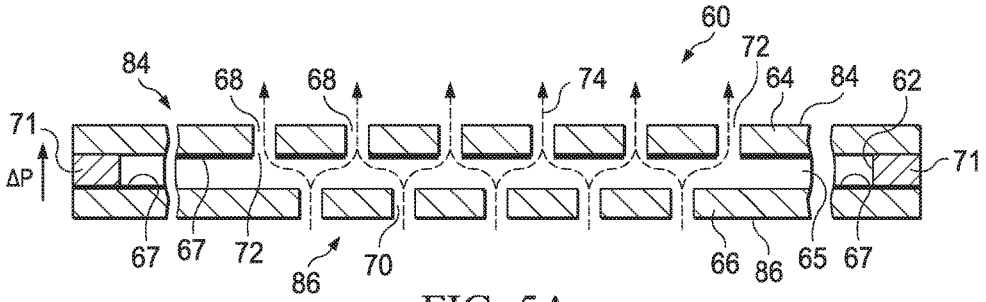
FIG. 5A shows a cross-section view of the valve of the disc pump in an open position when fluid flows through the valve.
Figure 5B:
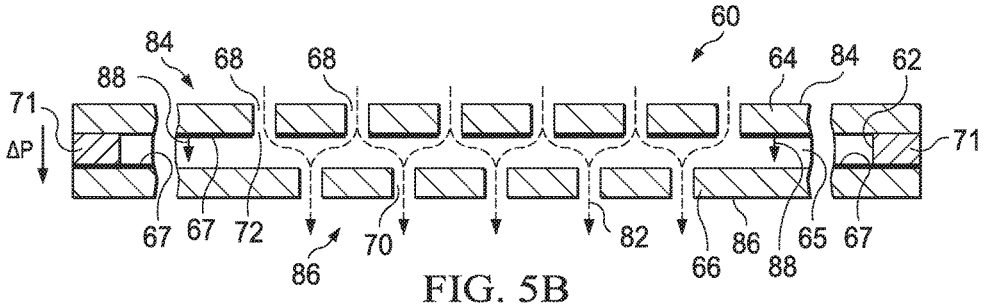
FIG. 5B shows a cross-section view of the valve of the disc pump in transition between the open and a closed position.
Figure 5C:
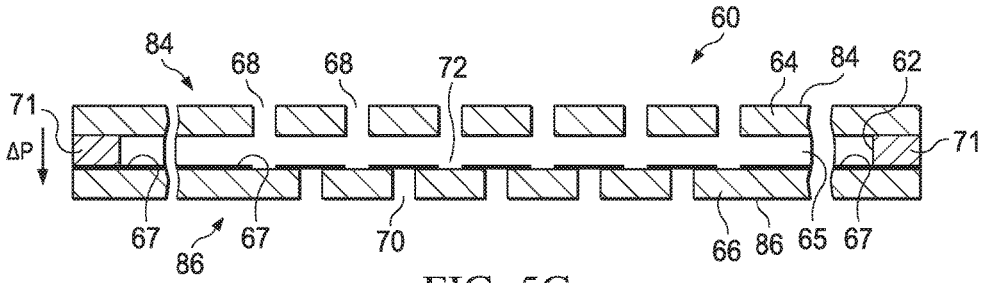
FIG. 5C shows a cross-section view of the valve of the disc pump in a closed position when fluid flow is blocked by a valve flap.

FIGS. 5A-5C illustrate how the flap 67 is motivated between the sealing plate 66 and the retention plate 64 when a force applied to either surface of the flap 67. When no force is applied to either surface of the flap 67 to overcome the bias of the flap 67, the valve 60 is in a "normally closed" position because the flap 67 is disposed adjacent the sealing plate 66 where the holes 72 of the flap are offset or not aligned with the holes 68 of the sealing plate 66. In this "normally closed" position, the flow of fluid through the sealing plate 66 is substantially blocked or covered by the non-perforated portions of the flap 67 as shown in FIG. 5C. When pressure is applied against either side of the flap 67 that overcomes the bias of the flap 67 and motivates the flap 67 away from the sealing plate 66 towards the retention plate 64 as shown in FIG. 5A, the valve 60 moves from the normally closed position to an "open" position over a time period, i.e., an opening time delay ($T_o$), allowing fluid to flow in the direction indicated by the dashed arrows 74. When the pressure changes direction as shown in FIG. 5B, the flap 67 will be motivated back towards the sealing plate 66 to the normally closed position. When this happens, fluid will flow for a short time period, i.e., a closing time delay ($T_c$), in the opposite direction as indicated by the dashed arrows 82 until the flap 67 seals the holes 70 of the sealing plate 66 to substantially block fluid flow through the sealing plate 66 as shown in FIG. 5C. In other embodiments of the invention, the flap 67 may be biased against the retention plate 64 with the holes 68, 72 aligned in a "normally open" position. In this embodiment, applying positive pressure against the flap 67 will be necessary to motivate the flap 67 into a "closed" position. Note that the terms "sealed" and "blocked" as used herein in relation to valve operation are intended to include cases in which substantial (but incomplete) sealing or blockage occurs, such that the flow resistance of the valve is greater in the "closed" position than in the "open" position.

The operation of the valve 60 is generally a function of the change in direction of the differential pressure ($\Delta P$) of the fluid across the valve 60. In FIG. 5B, the differential pressure has been assigned a negative value ($-\Delta P$) as indicated by the downward pointing arrow. When the differential pressure has a negative value ($-\Delta P$), the fluid pressure at the outside surface of the retention plate 64 is greater than the fluid pressure at the outside surface of the sealing plate 66. This negative differential pressure ($-\Delta P$) drives the flap 67 into the fully closed position, wherein the flap 67 is pressed against the sealing plate 66 to block the holes 70 in the sealing plate 66, thereby substantially preventing the flow of fluid through the valve 60. When the differential pressure across the valve 60 reverses to become a positive differential pressure (+ΔP) as indicated by the upward pointing arrow in FIG. 5A, the flap 67 is motivated away from the sealing plate 66 and towards the retention plate 64 into the open position. When the differential pressure has a positive value (+ΔP), the fluid pressure at the outside surface of the sealing plate 66 is greater than the fluid pressure at the outside surface of the retention plate 64. In the open position, the movement of the flap 67 unblocks the holes 70 of the sealing plate 66 so that fluid is able to flow through them and the aligned holes 72 and 68 of the flap 67 and the retention plate 64, respectively, as indicated by the dashed arrows 74.

When the differential pressure across the valve 60 changes from a positive differential pressure (+ΔP) back to a negative differential pressure (−ΔP) as indicated by the downward pointing arrow in FIG. 5B, fluid begins flowing in the opposite direction through the valve 60 as indicated by the dashed arrows 82, which forces the flap 67 back toward the closed position shown in FIG. 5C. In FIG. 5B, the fluid pressure between the flap 67 and the sealing plate 66 is lower than the fluid pressure between the flap 67 and the retention plate 64. Thus, the flap 67 experiences a net force, represented by arrows 88, which accelerates the flap 67 toward the sealing plate 66 to close the valve 60. In this manner, the changing differential pressure cycles the valve 60 between closed and open positions based on the direction (i.e., positive or negative) of the differential pressure across the valve 60.

When the differential pressure across the valve 60 reverses to become a positive differential pressure (+ΔP) as shown in FIG. 5A, the flap 67 is motivated away from the sealing plate 66 against the retention plate 64 into the open position. In this position, the movement of the flap 67 unblocks the holes 70 of the sealing plate 66 so that fluid is permitted to flow through them and the aligned holes 68 of the retention plate 64 and the holes 72 of the flap 67 as indicated by the dashed arrows 74. When the differential pressure changes from the positive differential pressure (+ΔP) back to the negative differential pressure (−ΔP), fluid begins to flow in the opposite direction through the valve 60 (see FIG. 5B), which forces the flap 67 back toward the closed position (see FIG. 5C). Thus, as the pressure oscillations in the cavity 16 cycle the valve 60 between the normally closed position and the open position, the disc pump 10 provides reduced pressure every half cycle when the valve 60 is in the open position.

As indicated above, the operation of the valve 60 may be a function of the change in direction of the differential pressure (ΔP) of the fluid across the valve 60. The differential pressure (ΔP) is assumed to be substantially uniform across the entire surface of the retention plate 64 because (1) the diameter of the retention plate 64 is small relative to the wavelength of the pressure oscillations in the cavity 65, and (2) the valve 60 is located near the center of the cavity 16 where the amplitude of the positive pressure peak 46 is relatively constant as indicated by the positive square-shaped portion of the positive central pressure peak 46 and the negative square-shaped portion of the negative central pressure peak 48 shown in FIG. 4B. Therefore, there is virtually no spatial variation in the pressure across the center portion of the valve 60.

Figure 6A:
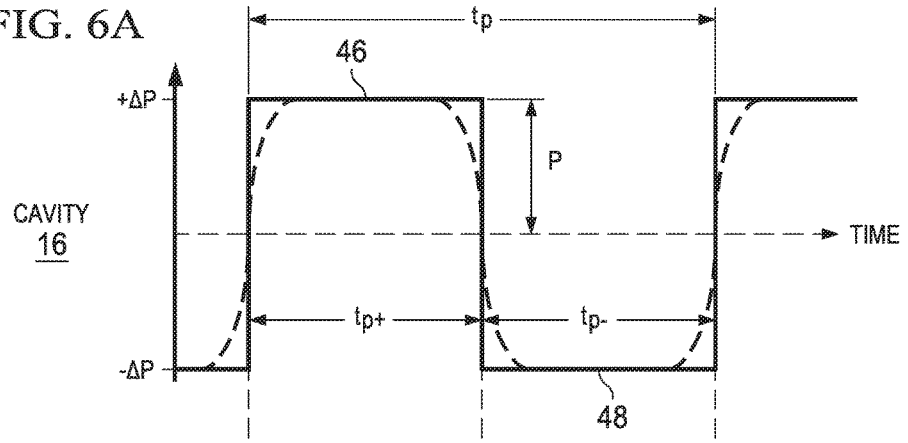
FIG. 6A shows a pressure graph of an oscillating differential pressure applied across the valve according to an illustrative embodiment.
Figure 6B:
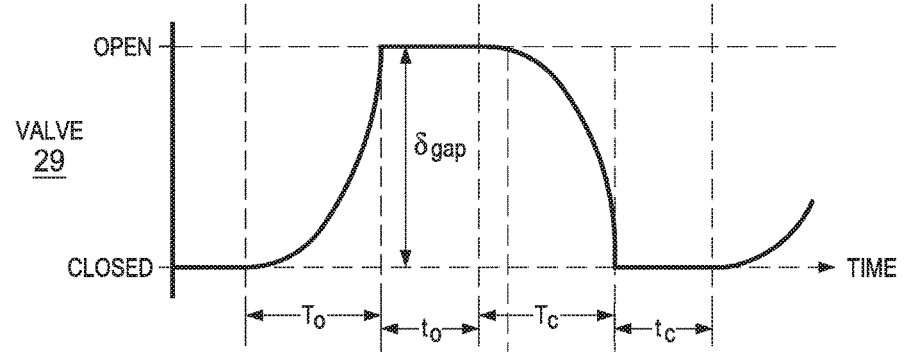
FIG. 6B shows the position of the valve relative to the oscillation differential pressure shown in FIG. 6A.
Figure 6C:
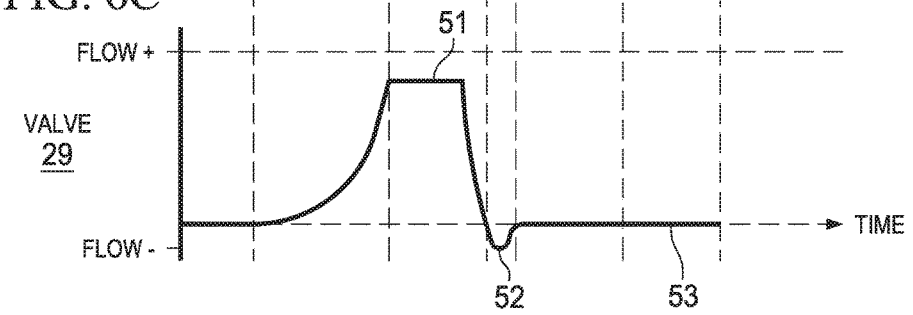
FIG. 6C shows a fluid-flow graph of an operating cycle of the valve between an open and closed position.

FIGS. 6A-6C further illustrate the dynamic operation of the valve 60 when it is subject to a differential pressure which varies in time between a positive value (+ΔP) and a negative value (−ΔP). While in practice the time-dependence of the differential pressure across the valve 60 may be approximately sinusoidal, the time-dependence of the differential pressure across the valve 60 is approximated as varying in the square-wave form shown in FIG. 6A to facilitate explanation of the operation of the valve 60. The positive differential pressure is applied across the valve 60 over the positive pressure time period ($t_p$+) and the negative differential pressure is applied across the valve 60 over the negative pressure time period ($t_p$−) of the square wave. FIG. 6B illustrates the motion of the flap 67 in response to this time-varying pressure. As differential pressure (ΔP) switches from negative to positive, the valve 60 begins to open and continues to open over an opening time delay ($T_o$) until the valve flap 67 meets the retention plate 64 as also described above and as shown by the graph in FIG. 6B. As differential pressure (ΔP) subsequently switches back from positive differential pressure to negative differential pressure, the valve 60 begins to close and continues to close over a closing time delay ($T_c$) as also described above and shown in FIG. 6B.

The retention plate 64 and the sealing plate 66 should be strong enough to withstand the fluid pressure oscillations to which they are subjected without significant mechanical deformation. The retention plate 64 and the sealing plate 66 may be formed from any suitable rigid material, such as glass, silicon, ceramic, or metal. The holes 68, 70 in the retention plate 64 and the sealing plate 66 may be formed by any suitable process including chemical etching, laser machining, mechanical drilling, powder blasting, and stamping. In one embodiment, the retention plate 64 and the sealing plate 66 are formed from sheet steel between 100 and 200 microns thick, and the holes 68, 70 therein are formed by chemical etching. The flap 67 may be formed from any lightweight material, such as a metal or polymer film. In one embodiment, when fluid pressure oscillations of 20 kHz or greater are present on either the retention plate side or the sealing plate side of the valve 60, the flap 67 may be formed from a thin polymer sheet between 1 micron and 20 microns in thickness. For example, the flap 67 may be formed from polyethylene terephthalate (PET) or a liquid crystal polymer film approximately three microns in thickness.

To generate the displacement and pressure oscillations described above with regard to FIGS. 4A and 4B, the actuator 30 is driven at the resonant cavity frequency ($f_c$) to create the pressure oscillations in the cavity 16 that drive the disc pump 10. In one embodiment, the resonant cavity frequency ($f_c$) is about 21 kHz at an ambient temperature, e.g., 20° C. To enhance pump efficiency, the actuator 30 is driven at the resonant cavity frequency ($f_c$). Yet in the disc pump 10 having a constant cavity size, the speed of sound in the air in the cavity 16 increases with temperature and causes a resultant increase in the resonant cavity frequency (Q. Since the temperature of the fluid in the cavity increases as the energy used to power the pump is dissipated, the resonant cavity frequency ($f_c$) may increase as the disc pump 10 warms up to the target operating temperature (T). Thus, if the actuator 30 is driven at an initial frequency ($f_i$) that corresponds to the resonant cavity frequency ($f_c$) at the start-up temperature, the initial frequency ($f_i$) and the resonant cavity frequency ($f_c$) will diverge as the disc pump 10 warms up to the operating temperature. Conversely, the drive frequency may be equivalent to the resonant cavity frequency ($f_c$) at the operating temperature, causing a divergence between the drive frequency and the resonant cavity frequency ($f_c$) when the disc pump 10 is near the start-up temperature. In either case, the divergence between the drive frequency and the resonant cavity frequency ($f_c$) may result in the disc pump 10 functioning less efficiently. To enhance the efficiency of the disc pump 10, a temperature sensor may be communicatively coupled to the cavity 16 of the disc pump 10 to measure the temperature of the fluid in the cavity 16. Using this measurement, the drive frequency may be instantaneously adjusted to the resonant cavity frequency ($f_c$) at the measured temperature.

The drive circuit is coupled to at least one of the conductive plate 40 and the actuator 30 to apply a drive signal. In one embodiment, the drive signal applies a charge 42 to the conductive plate 40 such that the conductive plate 40 functions as a stator to drive the actuator 30. The actuator 30 includes a conductive coating and is directly or indirectly coupled to a battery, the drive circuit, or another source of potential to establish a constant surface charge 32 at the surface of the actuator 30. The constant surface charge 32 causes the actuator 30 to function as a charged diaphragm. To conduct the surface charge 32, the actuator 30 includes a metallic film, layer or coating, or a surface that includes carbon nanotubes to hold a fixed charge. To prevent a short circuit or arcing between the conductive plate 40 and actuator 30, an insulating layer is included on the actuator 30 or conductive plate 40.

In another embodiment, the actuator 30 is formed from an insulating material, such as PVC, without a conductive coating. In such an embodiment, the actuator 30 becomes polarized by the charges on the conductive plate 40 and an optional second conductive plate in the end wall 20 that encloses the cavity 16. The polarized actuator 30 is operable to move in response to the application of the electrostatic force. In another embodiment, the actuator 30 is made from a poled electret material, such as polyvinylidene fluoride (PVDF), having a constant polarity that renders the material susceptible to electrostatic forces.

In an embodiment, the drive signal is an alternating current signal applied by the drive circuit to charge the conductive plate 40 and generate an oscillatory electrostatic field across the actuator 30. The oscillatory electrostatic field exerts attractive and repulsive electrostatic forces on the actuator 30, which has a positive or negative charge. For example, the drive signal may charge the conductive plate 40 to generate an oscillating electrostatic field having an alternating polarity relative to the actuator 30. When the actuator 30 and conductive plate have positive surface charges, the electrostatic field motivates the charged actuator 30 away from the conductive plate 40, i.e., repulsing the actuator 30 away from the conductive plate 40. The positively charged actuator 30 is then attracted back toward the conductive plate 40 when the charge 42 on the conductive plate 40 reverses to become a negative charge. In this manner, the continuous switching of the polarity of the charge 42 on the conductive plate 40 drives the actuator 30 to generate pressure oscillations within the cavity 16.

Figure 7:
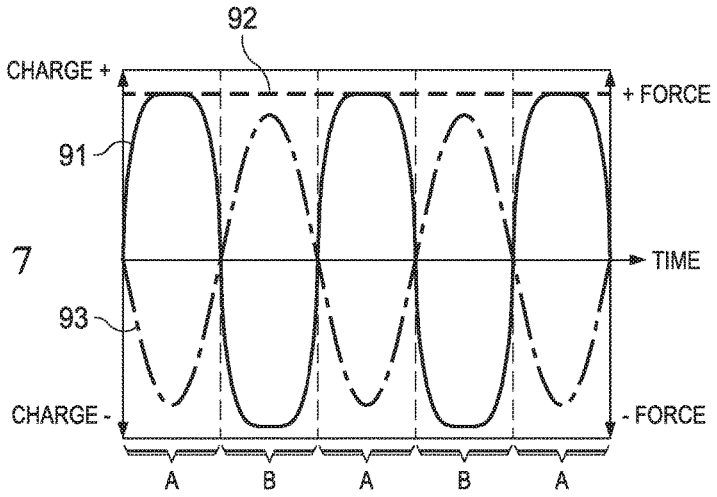
FIG. 7 is a graph showing the relationship between the surface charge on the conductive plate of the first disc pump of FIGS. 1A-1B, the surface charge on the electrostatically-driven actuator, and the magnitude of the electrostatic force exerted on the actuator, wherein the actuator has a constant surface charge.

The graph of FIG. 7 illustrates the forces exerted on the actuator 30 of the disc pump 10 of FIGS. 1A and 1B during the switching of the polarity of the charge 42 on the conductive plate 40 over the alternating timeslots A and B, which correspond to FIGS. 1A and 1B, respectively. A first line 91 illustrates the magnitude of the charge 42 on the conductive plate 40 that results from the application of the drive signal. During the A timeslots, a positive surface charge 42 rapidly builds up on the surface of the conductive plate 40, and during the B timeslots, the surface charge 42 is transitioned to a negative charge. A second line 92 indicates that the actuator 30 is held at a constant, positive charge 32 over both timeslots. A third line 93 illustrates the alternating attractive and repulsive forces exerted on the actuator 30 at each timeslot A and B. Thus, the positive charge 42 on the conductive plate 40 repulses the actuator 30 toward the end wall 20 at time A. At time B, the negative charge 42 on the conductive plate 40 attracts the actuator 30 toward the conductive plate 40 (i.e., away from the end wall 20). The resultant oscillatory movement of the actuator 30 generates pressure oscillations within the cavity 16, as described above. As the pressure oscillations within the cavity 16 generate fluid flow through the disc pump 10, the disc pump provides, for example, a reduced pressure to the load. The disc pump 10 may operate in this manner until the desired amount of reduced-pressure has been provided. When the desired amount of reduced pressure has been provided, the drive signal may generate a charge 42 on the conductive plate 40 having the same polarity as the charge 32 on the actuator 30. The similar charges 32, 42 result in the exertion of a repulsive force on the actuator 30 to seal the actuator 30 against the valve 29, thereby preventing leakage from the load through the disc pump 10.

Figure 3B:
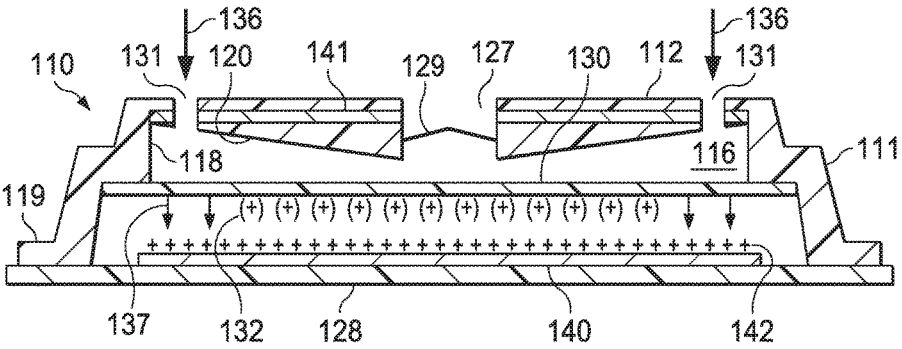
FIG. 3B is a cross-section view of the second disc pump having a negatively-charged, electrostatically-driven actuator and a positively-charged conductive plate.
Figure 3D:
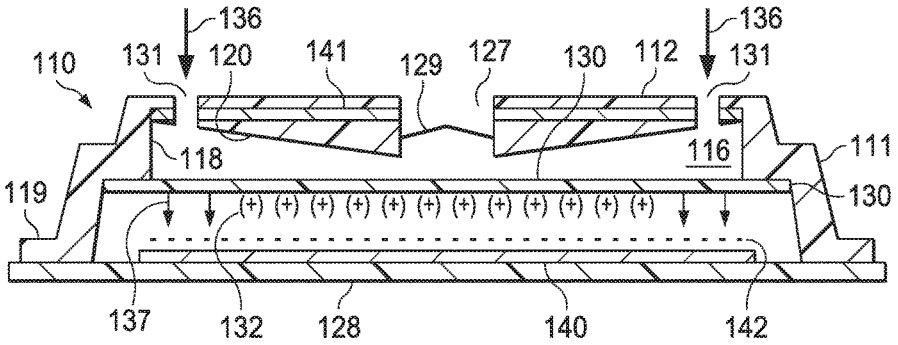
FIG. 3D is a cross-section view of the second disc pump having a positively-charged, electrostatically-driven actuator and a negatively-charged conductive plate.

In other embodiments, as illustrated in FIGS. 3A-3D, the actuator 130 has a variable surface charge 132 that may be actively generated by the drive circuit or induced by the surface charge 142 of the conductive plate 140. In an embodiment in which the actuator 130 has a passively generated variable surface charge 132, the disc pump 10 includes an actuator membrane formed from, for example, a dielectric material. The conductive plate 140 receives a drive signal that generates the charge 142 on the surface of the conductive plate 140. The charge 142 induces a charge 132 of opposing polarity on the surface of the actuator 130, as shown in FIG. 3B. The charges 132, 142 of opposing polarity result in an electrostatic force attracting the actuator 130 toward the conductive plate 140. When the charge 142 is switched from positive to negative, as shown in FIG. 3C, the charges 132 of the actuator 130 and the charge 142 of the conductive plate 140 are of similar (e.g., negative) polarity. The similar charges 132, 142 may repulse the actuator 130 away from the conductive plate 140. The negative charge 142 on the conductive plate 140, however, quickly induces a positive charge 132 on the surface of the actuator 130 to attract the actuator 30 toward the conductive plate 140 until the polarity of the conductive plate 140 switches again as shown in FIG. 3D. When the charge 142 is switched from negative to positive, as shown in FIG. 3A, the charges 132 of the actuator 130 and the charge 142 of the conductive plate 140 are again of similar (e.g., negative) polarity and the process repeats. As such, the polarity of the charge 142 is alternated to cause oscillatory motion of the actuator 130 and corresponding pressure oscillations within the pump cavity 116 at the resonant cavity frequency ($f_c$) to generate fluid flow through the disc pump 110.

In one embodiment in which the surface charge 132 on the actuator 30 is passively generated, the membrane used to form the actuator 130 is selected from a group of materials towards the extremes of the triboelectric series, such as a polyethylene or silicone rubber. In such an embodiment, the surfaces of the actuator 130 may be charged, or polarized, by contact electrification or the photoelectric, thermionic work functions of the actuator material. The resultant polarization of the actuator surface increases the magnitude of the force that may be generated to attract the actuator 130 toward or to repulse the actuator 130 from the conductive plate 140. Where the actuator surface charge is generated through induction as described above, the actuator 130 may be constructed without the necessity for wired electrical connections to the actuator 130. Still, such an embodiment may include an actuator 130 that incorporates a laminate material that includes a metal layer or coating to enhance the electrostatic properties of the actuator 130.

In an embodiment in which the surface charge 132 of the actuator 130 is actively generated by the drive circuit, the actuator 130 incorporates a conductive layer that is coupled to an external power source by, for example, a flexible circuit material. The flexible circuit material may be a flexible printed circuit board or any similar material. In such an embodiment, the actuator 130 may have a fixed surface charge 132 while the charge 142 of the conductive plate is switched, as described above with regard to FIG. 6. In another embodiment, the actuator 130 may be configured to operate in much the same way by supplying a fixed surface charge 142 to the conductive plate 140 while switching polarity of the surface charge 132 of the actuator 130.

In another embodiment, the drive circuit may switch the charges 132, 142 applied to both the actuator 130 and the conductive plate 40 to operate the pump 110 similarly to a pump 110 having a passively driven actuator 130. In such an embodiment, positive surface charges may first be applied to the actuator 130 and conductive plate 140 to repulse the actuator 130 away from the conductive plate 140 as shown in FIG. 3A. Subsequently, the charge 142 of the conductive plate 140 is reversed to generate an attractive electromagnetic force that pulls the still positively-charged actuator 130 back toward the conductive plate 140 as shown in FIG. 3B. While the conductive plate 140 remains positively charged, the drive circuit switches the charge 132 of the actuator 130 to a negative polarity so that the actuator 130 is again repulsed from the still-negatively charged conductive plate 140 as shown in FIG. 3C. To attract the actuator 130 back toward the conductive plate 140, the charge of the conductive plate 140 is switched back to a positive polarity to attract the negatively-charged actuator 130 as shown in FIG. 3D. The drive circuit may then reverse the charge 132 of the actuator 130 to a charge of positive polarity and repeat the cycle.

Figure 8:
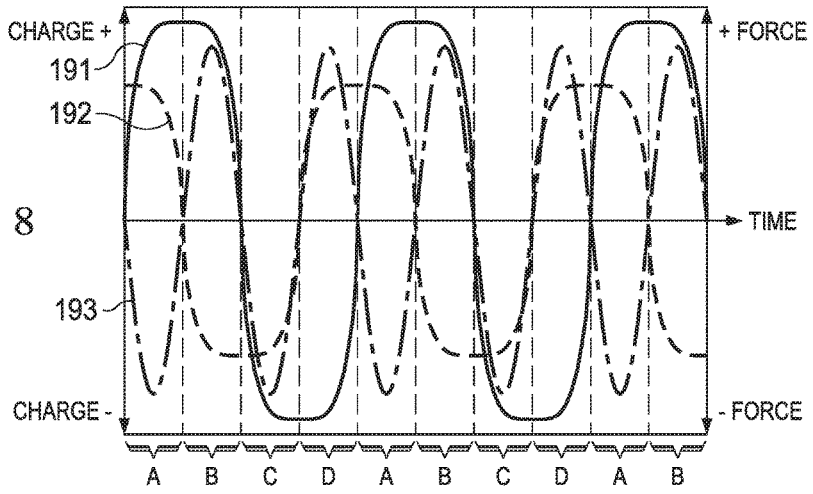
FIG. 8 is a graph showing the relationship between the surface charge on the conductive plate of the second disc pump of FIGS. 3A-3D, the surface charge on the electrostatically-driven actuator, and the magnitude of the electrostatic force exerted on the actuator, wherein the actuator has a variable surface charge.

The graph of FIG. 8 illustrates the forces exerted on a variably charged actuator 130 during the operation of a disc pump 110 in which the actuator 130 has a variable surface charge 132. In FIG. 8, the charges 132, 142 on the actuator 130 and conductive plate 140 are varied over time slots A, B, C, and D, which correspond to FIGS. 3A, 3B, 3C, and 3D, respectively. A first line 191 illustrates the magnitude of the charge 142 on the conductive plate 140 that results from the application of the drive signal. A positive charge 142 is generated on the surface of the conductive plate 140 during the A timeslot and is maintained through the B timeslot. During the C timeslot, the surface charge 142 transitions to a negative charge that is maintained through the D timeslot. A second line 192 indicates that the surface charge 132 of the actuator 130 alternates approximately half a timeslot after the conductive plate 140. In timeslot A, the surface charge 132 on the actuator 130 transitions to a negative surface charge that is maintained until the C timeslot when the actuator 130 transitions back to a positive surface charge 132. A third line 193 illustrates the alternating attractive and repulsive forces exerted on the actuator 130 at each timeslot A, B, C, and D, as a result of the opposing surface charges 132, 142 of the actuator 130 and conductive plate 140. The third line 193 indicates that the positive charge on the conductive plate 140 repulses the actuator 130 toward the end wall 120 at time A and the positive charge on the conductive plate 140 at time B attracts the negatively charged actuator 130 toward the conductive plate 140 (i.e., away from the end wall 120) at time B. Similarly, the negative surface charge on the conductive plate 140 repulses the negatively charged actuator 130 toward the end wall 120 at time C and the negative surface charge 142 on the conductive plate 140 attracts the positively charged actuator 130 at time D. The switching of the attractive and repulsive forces results in oscillatory motion of the actuator 130 that generates pressure oscillations within the cavity 116, as described above. When the desired amount of reduced pressure has been provided to the load, the drive signal may generate the static surface charges 132, 142 of opposing polarities on the actuator 130 and conductive plate 140 to exert a static, repulsive force that seals the actuator 130 against the valve 129 to seal the disc pump 110.

In another embodiment, the disc pump 110 includes the second conductive plate 141 to increase the magnitude of the electromagnetic forces applied to the actuator 30. The second conductive plate 141 may be included in the pump body end wall 112 on the opposite side of the actuator 130 from the conductive plate 140. Where the second conductive plate 141 is included, the drive signal is applied to the second conductive plate 141 to induce a second charge on the surface of the second conductive plate 141 of opposing polarity to the charge 142 applied to the conductive plate 140. The second charge of the second conductive plate 141 and the surface charge 142 of the conductive plate 140 both contribute to a directional electric field across the actuator 130. In an embodiment, the conductive plates 140, 141 have opposing fixed surface charges and the surface charge 132 of the actuator may be alternated by the drive signal to generate attractive and repulsive forces. In another embodiment, the actuator 130 may have a fixed surface charge while the surface charges of the conductive plates 140, 141 are alternated to reverse the polarity of the electric field and move the actuator 130.

Figure 9:
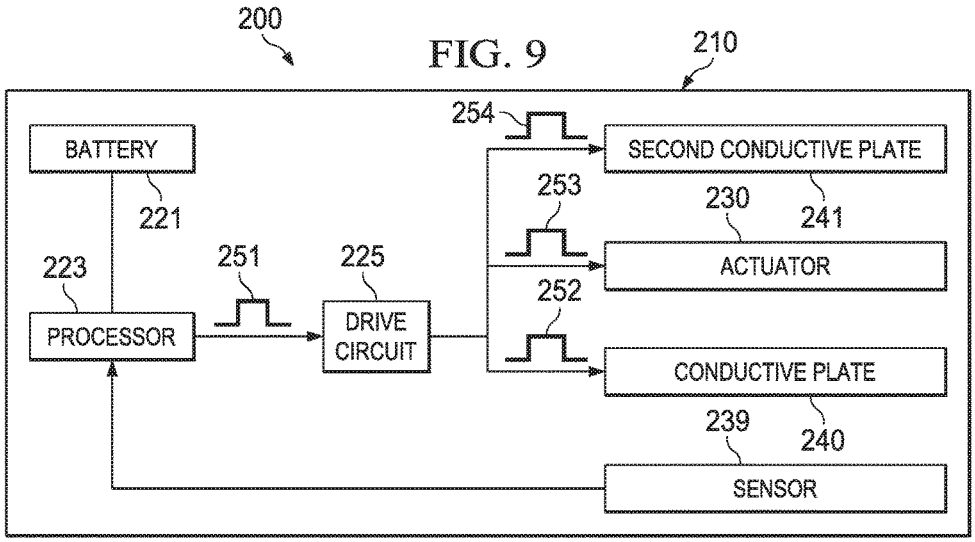
FIG. 9 is a block diagram of an illustrative circuit of a disc pump system that includes a disc pump analogous to the first disc pump of FIGS. 1A-1B.

A representative disc pump system 200 that includes an electrostatic drive mechanism is shown in FIG. 9. The disc pump system 200 includes disc pump 210 having a battery 221 that provides power to a processor 223 and a drive circuit 225. The processor 223 communicates a control signal 251 to the drive circuit 225, which in turn applies drive signals to the actuator 260 and one or more conductive plates of the disc pump 210. For example, the drive circuit 225 may apply a conductive plate drive signal 252 to the conductive plate 240. Similarly, the drive circuit 225 may apply an actuator drive signal 253 to the actuator 230. In an embodiment in which the disc pump 210 includes a second conductive plate 241, the drive circuit 225 applies a second conductive plate drive signal 254 to the second conductive plate 241. The drive signals 252, 253, 254 may result in a static charges or variable charges on the surfaces of the conductive plate 240, the actuator 230, and the second conductive plate 241, respectively. In an embodiment, the drive circuit 225 provides the one or more drive signals 252, 253, 254 to drive the actuator 230 at a frequency (f), which may be the resonant cavity frequency ($f_c$). The disc pump 210 may also include a sensor 239, such as a temperature sensor, to determine the temperature of the components of the disc pump 210, including the cavity 216 and the fluid within the cavity 216. The sensor 239 is communicatively coupled to the processor 223, which may analyze temperature data received from the sensor 239 to derive the control signal 251. Using the temperature data, the processor 223 may determine the temperature related variance in the resonant cavity frequency ($f_c$). Based on this determination, the processor 223 may vary the control signal 251 to cause the drive circuit 225 to vary the drive signals 252, 253, 254 to account for any temperature related variances in the resonant cavity frequency ($f_c$).

It should be apparent from the foregoing that an invention having significant advantages has been provided. While the invention is shown in only a few of its forms, it is not so limited and is susceptible to various changes and modifications without departing from the spirit thereof.

We claim:

1. A disc pump system comprising:

a pump body having a cylindrical sidewall closed at both ends by a first end wall and a driven end wall to form a cavity for containing a fluid;

an actuator comprising a conductive layer and operatively associated with the driven end wall to cause an oscillatory motion of the driven end wall at a drive frequency, thereby generating displacement oscillations of the driven end wall in a direction perpendicular thereto;

a substrate, the driven end wall disposed between the first end wall and the substrate;

a cylindrical leg structure extending from the cylindrical sidewall and mounted to the substrate, the cylindrical leg structure spacing the substrate from the driven end wall;

a conductive plate mounted to the substrate and operatively associated with the actuator and parallel to the actuator;

a first aperture disposed in either one of the end walls and extending through the pump body;

one or more second apertures disposed in the pump body and extending through the pump body;

a valve disposed in at least one of the first aperture and second apertures;

a temperature sensor communicatively coupled to the cavity; and a drive circuit coupled to the actuator and the conductive plate, the drive circuit configured to drive the actuator and the conductive plate at the drive frequency, the drive circuit further configured to adjust the drive frequency in response to a temperature of the cavity determined by the temperature sensor.

2. The disc pump system of claim 1, wherein the actuator comprises a flexible membrane having a metallic layer.

3. The disc pump system of claim 1, wherein the drive circuit is coupled to a power source.

4. The disc pump system of claim 1, further comprising a second conductive plate, the drive circuit being coupled to the second conductive plate.

5. The disc pump system of claim 1, wherein the actuator is operable to reverse polarity in response to receiving a drive signal from the drive circuit.

6. The disc pump system of claim 1, wherein the conductive plate is operable to reverse polarity in response to receiving a drive signal from the drive circuit and the actuator is operable to maintain a constant charge in response to receiving a second drive signal from the drive circuit.

7. The disc pump system of claim 1, wherein the actuator is operable to seal against the valve in response to receiving a drive signal from the drive circuit.

8. A method for operating a disc pump, the method comprising:

providing the disc pump, the disc pump comprising:

a pump body having a cylindrical sidewall closed at both ends by a first end wall and a driven end wall to form a cavity for containing a fluid, an actuator comprising a conductive layer and operatively associated with the driven end wall to cause an oscillatory motion of the driven end wall at a drive frequency, thereby generating displacement oscillations of the driven end wall in a direction perpendicular thereto, a substrate, the driven end wall disposed between the first end wall and the substrate, a cylindrical leg structure extending from the cylindrical sidewall and mounted to the substrate, the cylindrical leg structure spacing the substrate from the driven end wall, and a conductive plate mounted to the substrate and operatively associated with the actuator and parallel to the actuator;

applying a drive signal to the conductive plate of the disc pump to cause the conductive plate to switch between a positive charge and a negative charge;

driving the actuator of the disc pump at a frequency (f) that is equivalent to a resonant frequency of the cavity in response to the positive charge and the negative charge;

generating displacement oscillations of the actuator in a direction substantially perpendicular thereto;

generating pressure oscillations of fluid within the cavity to cause fluid flow through a valve of the disc pump, the pressure oscillations corresponding to the displacement oscillations;

measuring a temperature in the cavity with a temperature sensor; and adjusting the frequency (f) in response to the measured temperature.

9. The method of claim 8, wherein the actuator comprises a dielectric membrane, and wherein driving the actuator of the disc pump comprises inducing a surface charge on the dielectric membrane.

10. The method of claim 8, further comprising applying a second drive signal to a conductive layer of the actuator.

11. The method of claim 10, wherein the second drive signal is a constant electrical charge.

12. The method of claim 8, further comprising applying a second drive signal to a second conductive plate of the disc pump.

* * * * *